US012702199B2

(12) United States Patent
Giupponi

(10) Patent No.: US 12,702,199 B2
(45) Date of Patent: Aug. 11, 2026

(54) WATERPROOF AND WATER VAPOUR PERMEABLE FOOTWEAR

(71) Applicant: W. L. Gore & Associati S.r.l., Verona (IT)

(72) Inventor: Andrea Giupponi, Verona (IT)

(73) Assignee: W. L. Gore & Associati S.r.l., Verona (IT)

( * ) Notice: Subject to any disclaimer, the term of this patent is extended or adjusted under 35 U.S.C. 154(b) by 0 days.

(21) Appl. No.: 18/236,479

(22) Filed: Aug. 22, 2023

(65) Prior Publication Data

US 2024/0057718 A1 Feb. 22, 2024

(30) Foreign Application Priority Data

Aug. 22, 2022 (EP) ..... 22425036

(51) Int. Cl.
*A43B 23/02* (2006.01)
*A43B 13/38* (2006.01)
*A43B 23/08* (2006.01)

(52) U.S. Cl.
CPC ..... *A43B 23/022* (2013.01); *A43B 13/38* (2013.01); *A43B 23/026* (2013.01); *A43B 23/081* (2013.01)

(58) Field of Classification Search
None
See application file for complete search history.

(56) References Cited

U.S. PATENT DOCUMENTS 4,899,465 A * 2/1990 Bleimhofer ..... A43B 1/0072 36/12
5,289,644 A * 3/1994 Driskill ..... A43B 7/125 36/12
5,505,011 A * 4/1996 Bleimhofer ..... A43B 7/125 36/4
5,711,093 A * 1/1998 Aumann ..... A43B 7/125 36/77 R (Continued)

FOREIGN PATENT DOCUMENTS

CN 213370279 U 6/2021
DE 20209669 U1 8/2002

(Continued)

OTHER PUBLICATIONS

European Search Report for EP Patent Application No. 22425036.5, Issued on Jan. 30, 2023, 8 pages.

*Primary Examiner* — Jila M Mohandesi

(57) ABSTRACT

The present application relates to a waterproof and water vapour permeable footwear article comprising an upper, an insole, a sole, and a net material; wherein the upper comprises an outer material and a waterproof and water vapour permeable membrane, and wherein the waterproof and water vapour permeable membrane is laminated to the surface of the outer material facing the inside of the footwear article; wherein at least the top end of the net material is attached to the waterproof and water vapour permeable membrane of the upper at the bottom perimeter edge of the upper on the surface of the waterproof and water vapour permeable membrane that faces the inside of the footwear article and a method of making such a waterproof and water vapour permeable footwear article.

11 Claims, 5 Drawing Sheets

(56) References Cited

U.S. PATENT DOCUMENTS

| | | | | |
|---|---|---|---|---|
| 6,820,352 | B2 * | 11/2004 | Keidel | A43B 7/32 36/12 |
| 7,013,580 | B2 * | 3/2006 | Morlacchi | A43B 7/125 36/12 |
| 7,017,284 | B2 * | 3/2006 | Keidel | A43B 9/02 36/55 |
| 7,159,335 | B2 * | 1/2007 | Chen | A43B 7/125 36/12 |
| 8,281,502 | B2 * | 10/2012 | Haimerl | A43B 9/00 36/19 R |
| 2001/0049889 | A1 | 12/2001 | Chen | |
| 2003/0000111 | A1 | 1/2003 | Basso | |
| 2003/0041474 | A1 | 3/2003 | Keidel et al. | |
| 2006/0248751 | A1 | 11/2006 | Haimerl | |
| 2011/0252667 | A1 | 10/2011 | Polegato Moretti | |
| 2014/0165422 | A1 * | 6/2014 | Pfister | D04B 21/16 36/45 |

FOREIGN PATENT DOCUMENTS

| | | | |
|---|---|---|---|
| DE | 20315772 | U1 | 3/2004 |
| EP | 1290957 | A2 | 3/2003 |
| JP | 07-222603 | A | 8/1995 |
| JP | 2002-172003 | A | 6/2002 |
| JP | 2002-345505 | A | 12/2002 |
| JP | 2005-520611 | A | 7/2005 |
| JP | 2006-512132 | A | 4/2006 |
| JP | 2012-513223 | A | 6/2012 |
| JP | 2020-527078 | A | 9/2020 |
| KR | 10-0996943 | B1 | 11/2010 |
| KR | 10-2014-0135807 | A | 11/2014 |
| WO | 02/98255 | A1 | 12/2002 |
| WO | 2010/072547 | A1 | 7/2010 |

* cited by examiner

WATERPROOF AND WATER VAPOUR PERMEABLE FOOTWEAR

CROSS-REFERENCE TO RELATED APPLICATION

This application claims priority to EP Application No. 22425036.5, filed Aug. 22, 2022, which is incorporated herein by reference in its entirety for all purposes.

FIELD OF THE INVENTION

The present invention relates to waterproof and water vapour permeable footwear articles comprising an upper, an insole, a sole and a net material. The upper comprises a waterproof and water vapour permeable membrane and an outer material. A method of preparing the waterproof and water vapour permeable footwear article is also provided.

BACKGROUND OF THE INVENTION

Waterproof and water vapour permeable footwear articles comprising a waterproof and water vapour permeable upper material are used for a variety of purposes, such as outdoor sports but also for heavy duty work for example in the field of fire safety, health work, police, machinery and defence where footwear is usually thicker and sturdier. Such waterproof and water vapour permeable footwear articles provide protection from elements such as water, fluids, mud and snow, whilst also providing durability and protection.

In particular in the heavy duty field it is desirable that the footwear articles reliably provide waterproofness during use. For example, in the field of fire safety water ingress in boots may render these boots cold, heavy and uncomfortable to wear compromising the safety of the wearer. Heavy boots can prevent the wearer from moving quickly, while feeling uncomfortable will distract the attention of the wearer.

In addition, waterproof and water vapour permeable footwear articles used in heavy duty work or for outdoor applications often require complex upper materials which can withstand high mechanical stress. In particular, sealing the area between the upper and the sole can pose problems in manufacturing of these waterproof and water vapour permeable footwear articles.

Thus, there is a need for waterproof and water vapour permeable footwear articles, in particular in heavy duty applications, that provide reliable waterproofness and water vapour permeability. In particular, there is a need for suitable sealing between the upper and the sole of waterproof and water vapour permeable footwear articles. There is a further need for improved methods of manufacturing of such waterproof and water vapour permeable footwear avoiding the above problems.

SUMMARY OF THE INVENTION

A waterproof and water vapour permeable footwear article is provided which comprises an upper, an insole, a sole, and a net material. The upper comprises an outer material and a waterproof and water vapour permeable membrane which is laminated to the surface of the outer material facing the inside of the waterproof and water vapour permeable footwear article. At least the top end of the net material is attached to the waterproof and water vapour permeable membrane of the upper at the bottom perimeter edge of the upper and on the surface of the waterproof and water vapour permeable membrane that faces the inside of the waterproof and water vapour permeable footwear article.

The net material may be attached to the waterproof and water vapour permeable membrane with a seam. The net material and the waterproof and water vapour permeable membrane may overlap. The net material and the waterproof and water vapour permeable membrane overlap for at least 6 mm. The net material may be attached to the waterproof and water vapour permeable membrane with the outside facing surface of the net material. Alternatively, the net material may comprise a rolled edge at the top end such that the inside facing surface of the net material may be attached to the waterproof and water vapour permeable membrane. In this regard the inside facing surface of the net material and the outside facing surface of the net material are defined at the bottom end of the net material.

At least the bottom end of the net material may be attached to the insole. The net material may be attached to the insole with a seam. The net material may be attached to the insole with adhesive. In embodiments, in some portions of the footwear article the net material is attached to the insole with adhesive and in other portions with a seam.

The insole may be a lasting board, a strobel board or a toe lasting board. The insole may comprise a window. The window allows injected sole polymer to flow through the window towards the waterproof and water vapour permeable membrane. Around the window a spacer material may be attached on the upper surface of the insole facing the underside of the foot of the wearer. The spacer material may comprise channels. The channels may be directed from the window outward.

The upper may further comprise a backing layer. The backing layer may be a textile layer or a mesh layer laminated to the inside facing surface of the waterproof and water vapour permeable membrane. The textile layer may be a knit or a woven. The backing layer must have an open structure to allow for the injected sole polymer to penetrate and to reach the waterproof and water vapour permeable membrane of the upper.

At least one textile layer may be laminated to the outside facing surface of the waterproof and water vapour permeable membrane. The textile may be a knit, a woven or a nonwoven.

The waterproof and water vapour permeable footwear article may further comprise a liner. The liner is located on the inside of the upper. The liner may comprise at least one textile layer or a mesh material. The liner may comprise at least one textile layer and a waterproof and water vapour permeable membrane. The liner may be a laminate comprising a water proof and water vapour permeable membrane sandwiched between two textile layers. The liner may be in the form of a bootie. The liner may form a bootie only in the toe area. At the bottom the bootie may comprise a different material than at the sides of the bootie. At the bottom of the bootie the liner may be reinforced with a different material. When the liner is open at the bottom and comprises a waterproof and water vapour permeable membrane, the waterproof and water vapour permeable membrane faces the net material. In order for the injected sole polymer to reach waterproof and water vapour permeable membrane of the liner, any backing layer located between the waterproof and water vapour permeable membrane must have an open structure.

A protective toe cap may be attached to the upper on the inside of the waterproof and water vapour permeable footwear article. The protective toe cap may be located between the upper and the liner.

The waterproof and water vapour permeable footwear article may further comprise a protective layer, preferably a polyurethane layer. The protective layer may be a rubber layer. The protective layer may be located on the outside of the waterproof and water vapour permeable footwear article. The protective layer may be attached to the outside of the bottom perimeter of the upper and to the net material. The protective layer may be attached to net material by injection of sole polymer. The protective layer may be attached to the net material with adhesive.

Further provided is a method of making a waterproof and water vapour permeable footwear article comprising providing an upper having at least one outer layer and a waterproof and water vapour permeable membrane laminated to the outer layer on the surface facing the inside of the waterproof and water vapour permeable footwear article, an insole, a sole and a net material, optionally providing a liner material which optionally comprises at least one waterproof and water vapour permeable membrane, attaching at least the top end of the net material to the waterproof and water vapour permeable membrane of the upper at the bottom perimeter edge of the upper on the surface of the waterproof and water vapour permeable membrane that faces the inside of the waterproof and water vapour permeable footwear article.

The method may further include the step of attaching the bottom end of the net material to the insole. As a further step the sole is injected.

The method may further include the step of injecting a sole.

Different embodiments of the present invention may be applied to the toe region and the rest of the footwear article.

BRIEF DESCRIPTION OF THE DRAWINGS

The features of the invention will be better understood by anyone skilled in the art from the following description and accompanying drawings, provided by way of nonlimiting examples, in which.

DETAILED DESCRIPTION

Figure 1:
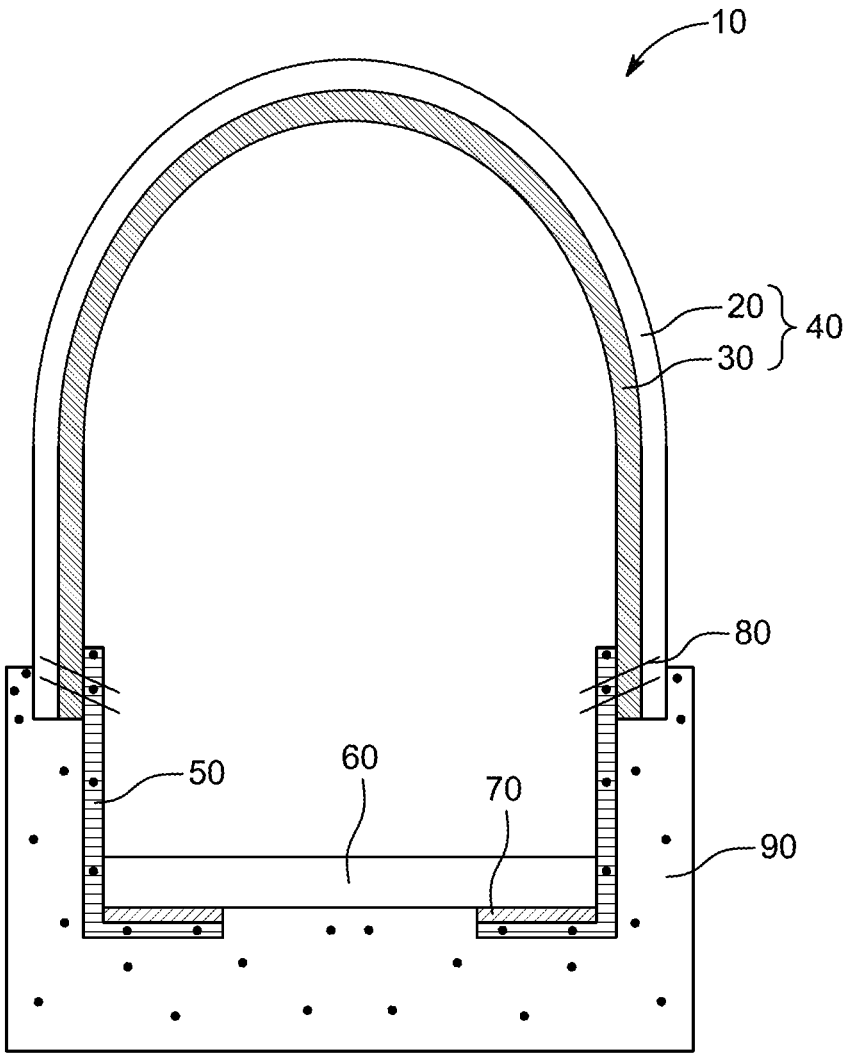
FIG. 1 is a cross-sectional view of a waterproof and water vapour permeable footwear article comprising a net material.

While the various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The term "footwear" or "footwear article" refers to outer coverings for feet such as shoes, boots, sneakers and the like.

The invention relates to a waterproof and water vapour permeable footwear article and a method for making said waterproof and water vapour permeable footwear article. The waterproof and water vapour permeable footwear article includes an upper, an insole, a sole, and a net material. The net material has to be permeable for the polymeric material that is injected to mould the sole. Preferably, the net material is an open mesh material or a textile material comprising openings. These openings maybe formed from staples, loops or stitches, or similar structures which allow for the injected sole polymeric material to flow through the openings. Sufficient flow of the injected sole polymeric material allows the formation of a durable waterproof seal to be formed between the waterproof and water vapour permeable membrane of the upper and the waterproof sole. In addition, the net material requires sufficient mechanical strength for the lasting or Strobel process before the sole is injected.

The upper comprises an outer material and a waterproof and water vapour permeable membrane which are laminated. The upper may further comprise at least one textile layer between the outer material and the waterproof and water vapour permeable membrane. On the side of the waterproof and water vapour permeable membrane which faces the inside of the footwear article a backing layer may be laminated. The backing layer may be an open mesh material or a textile layer. Textile layer and open mesh material in regard of the backing layer means any material that allows for the injected polymeric material of the sole to fully penetrate the textile layer or the open mesh material. The textile layer is preferably a knit or a woven. Openings between the fibres, filaments or yarn provide sufficient openings for the injected polymeric sole material to penetrate to reach the waterproof and water vapour permeable membrane. The outer material and the waterproof and water vapour permeable membrane are laminated to each other such that the outer material and the waterproof and water vapour permeable membrane are attached over most of the surface. The waterproof and water vapour permeable membrane of the upper may be comprised of a laminate having 2, 3 or 4 layers (including the waterproof and water vapour permeable laminate).

The outer material can be made from any material that is typically used for this purpose. Examples include leather, synthetic leather and textile fabrics. Typically, textile fabrics comprise polyester, polypropylene, polyamide (e.g. nylon) or cotton. The outer material may be a laminate comprising two or more layer of the above materials.

Textile fabrics may comprise filaments, such a monofilaments, or fibres, or any mixtures thereof. Fibres include natural and synthetic fibres and any mixtures thereof. Natural fibres include cellulosic types such as cotton, hemp or linen; animal fibres such as silk, angora, sheep's wool, alpaca, cashmere, mohair and any combination thereof.

Synthetic fibres include fibres based on acrylic polymers, polyesters, polyolefins, polyurethanes, polyamides and any combination thereof. The textile fabrics may be knit fabrics, woven fabrics, or nonwoven fabrics. The fabrics may stretch. The stretchiness may be due to the use of stretchable yarns or fibres, made for example from elastomers. The stretchiness may be due to the way the yarns or fibres are knitted or woven.

As used herein, the term "knit fabric" refers to any fabric or textile having a configuration with at least one yarn, thread or monofilament turned into consecutive rows of loops, called loop stitches. As each row progresses, a new loop is pulled through an existing loop. The active loop stitches are held on a needle until another loop can be passed through them.

In the process of knitting a fabric is formed by the intermeshing of loops of yarn, yarns or monofilaments. Each thread of yarn or monofilament follows a meandering path, called course, thus forming loops symmetrically to the meandering path of the thread. When one loop is drawn through another, loop stitch is formed. Loop stitches may be formed in horizontal (weft knitting) or vertical direction (warp knitting). A sequence of loop stitches in which each stitch is suspended from the next is called a wale.

Weft knitting is a method of forming a fabric in which the loops are made in horizontal way from a single yarn or monofilament, and intermeshing of loops takes place in a crosswise direction, i.e. the wales are perpendicular to the course of the yarn or monofilament. Weft knitting may be knit using only one yarn or monofilament, or using a multiplicity of yarns or monofilaments.

Warp knitting is a method of fabric forming in which the loops are made in a vertical way along the length of the fabric from each warp yarn or monofilament, and intermeshing of loops takes place in a lengthwise direction. In warp knitting, the wales and courses run parallel. One yarn or monofilament is required for each wale, thus numerous ends of yarns or monofilaments are being fed simultaneously to individual needles placed in a lateral direction.

Preferred knit materials comprise fibres made from polyamide such as nylon (PA 6 or PA 6.6) or polyester.

"Woven" refers to a fabric or textile formed by weaving. Weaving is a process of fabric forming by the interlacement of warp and weft yarns. Both warp and weft yarns run essentially straight and parallel to each other, either lengthwise (warp) or crosswise (weft).

"Nonwoven" are typically defined as sheet or web structures where fibres or filaments are entangled mechanically, thermally or chemically. Fibres are laid out in the form of a sheet or web, typically in a random configuration, and then bound either mechanically, such as by needle punching or hydroentangling, or chemically by application of a binder onto the sheet or web, or thermally by melting the fibres or filaments at least partially for bonding with or without a binder present.

In embodiments the upper may be a laminate comprising four layers. An outermost layer of this laminate may be made of microfibres. This outermost layer may be laminated to a nonwoven layer. On the surface opposite to the microfibre layer the nonwoven layer may be laminated to a waterproof and water vapour permeable membrane. As a fourth layer a textile layer may be laminated on the surface of the waterproof and water vapour permeable membrane that is opposite from the nonwoven layer. This layer is facing the inside of the footwear in the upper. This layer may be an open mesh material such as a knit. The open mesh structure allows for the sole material to penetrate through the textile layer onto the waterproof and water vapour permeable membrane. Preferably the microfibres are made from polyamide or polyurethane. Preferably the nonwoven layer is made from polyester or polyamide, for example nylon.

In embodiments, the outer layer may have been treated to be durable water repellent (DWR). DWR is a treatment of coating, immersing or spraying a hydrophobic agent to fabrics to render them water-resistant or hydrophobic. Preventing the fabric from becoming saturated with water avoids reduction of the breathability of the functional layer.

The waterproofness of footwear may be determined by use of the Centrifuge test described in U.S. Pat. No. 5,329,807, and incorporated by reference herein in its entirety. The centrifuge tests may be carried out for 30 minutes. The footwear article is considered to be waterproof if no leakage is seen after 30 minutes.

The water vapour permeability of footwear may be assessed in accordance with the determination of the Whole Boot Moisture Vapor Transmission Rate Test in accordance with the Department of Defense Army Combat Boot Temperate Weather Specifications. The specifications are as follows:

Whole Boot Water Vapour Permeability

The boot vapour permeability test shall be designed to indicate the Moisture Vapor Transmission Rate (MVTR) through the test sample by means of a difference in concentration of moisture vapor between the interior and the exterior environment.

Apparatus a) The external test environment control system shall be capable of maintaining 23 (±1)° C. and 50%±2% relative humidity throughout the test duration.
b) The weight scale shall be capable of determining the weight of test samples filled with water to an accuracy of (±0.01) gram.
c) The water holding bag shall be flexible so that it can be inserted into the test sample and conform to the interior contours; it must be thin enough so that folds
do not create air gaps; it must have much higher MVTR than the footwear product
to be tested; and it must be waterproof so that only moisture vapor contacts the
interior of the footwear product rather than liquid water.
d) The internal heater for the test sample shall be capable of controlling the temperature of the liquid water uniformly in the test sample to 35 (±1)° C.
e) The sealing method around the collar of the test sample shall be impervious to both liquid water and water vapour.

Procedure a) Place sample in test environment and condition for at least 12 hours.
b) The heating device is inserted into the water holding bag and the complete assembly is then placed into the test sample opening and filled with water to a height of 5 cm measured from inside sole.
c) Seal opening around the collar with plastic wrap around the top of the footwear and tape over using packaging tape.
d) Heat water in test sample to 35° C.

e) Weigh test sample and record as Wi.

f) Hold temperature in test sample after weighing for a minimum of 4 hours.

g) After a minimum of 4 hours, reweigh test sample. Record weight as Wf and test duration as Td.

h) Calculate MVTR of the test sample in grams/hour from the equation below:

i) MVTR=(Wi−Wf)/Td.

This test is in accordance with ASTM D8041 (2016). For example, for a low ankle shoe of European shoe size 42, the footwear may be considered breathable if above calculated value is above 1.5 grams/hour. For larger or smaller shoe sizes, said limit value may be extrapolated in accordance with the increased or decreased surface area of the shoe.

The waterproof and water vapour permeable membrane is considered to have waterproof characteristics when the requirements specified in DIN EN 343 (2010) are met, i.e. a test of the liquid water resistance with respect to hydrostatic water pressure according to EN 20 811 (1992) yields a liquid water resistance Wp of 8000 Pa, or more.

Water vapor permeability of the waterproof and water vapour permeable membrane is tested and defined in EN ISO 15496, also known as the "Cup Test". A 20 cm×20 cm or a circular ø100 mm sample of the waterproof and water vapour permeable membrane is placed onto a container containing water and covered with a water vapor permeable and waterproof membrane. Then a cup containing potassium acetate and being covered by the same membrane is placed on the sample. Water vapor passes through the waterproof and water vapour permeable membrane into the cup, whose weight increase is then determined. The waterproof and water vapour permeable membrane is considered water vapor permeable or breathable if the water vapor permeability is greater than or equal to 0.01 g/(Pa m2 h). If the required size of the sample cannot be obtained, a smaller sample may be used for the measurement using a smaller cup containing half the amount of potassium acetate specified in the Norm, i.e. 50 g instead of 100 g and mixed with 15.6 g of water. The terms water vapor permeability and breathability are used interchangeably herein.

Non-limiting examples of suitable synthetic polymer membranes which are waterproof and water vapour permeable include polyurethanes, polytetrafluoroethylene (PTFE), expanded polytetrafluoroethylene (ePTFE), polyvinylidene fluoride (PVDF), fluorinated ethylene propylene (FEP), perfluoroalkoxy alkane (PFA), modified polytetrafluoroethylene polymers, tetrafluoroethylene (TFE) copolymers, polyalkylenes such as polypropylene and polyethylene, polyether sulfone (PES), polyesters, poly (p-xylylene) (ePPX) as taught in U.S. Patent Publication No. 2016/0032069, porous ultra-high molecular weight polyethylene (eUHMWPE) as taught in U.S. Pat. No. 9,926,416 to Sbriglia, U.S. Patent Application No. 2021/0317276 to Bell, PCT Patent Application No. 2020/28331 to Bell, porous ethylene tetrafluoroethylene (eETFE) as taught in U.S. Pat. No. 9,932,429 to Sbriglia, porous polylactic acid (ePLLA) as taught in U.S. Pat. No. 7,932,184 to Sbriglia, et al., porous vinylidene fluoride-co-tetrafluoroethylene or trifluoroethylene [VDF-co-(TFE or TrFE)] polymers as taught in U.S. Pat. No. 9,441,088 to Sbriglia and copolymers and combinations thereof.

The waterproof and water vapour permeable membrane may comprise at least one of expanded polytetrafluorethylene (ePTFE), expanded polyethylene, expanded polypropylene, expanded polyolefins, polyurethane, polyester and copolyether ester, polyether, expanded polyether, polyamide, copolyether amides and polyacrylate, and composites or multilayer laminates thereof. The waterproof and water vapour permeable membrane may be made of a fluoropolymer, particularly made of microporous expanded polytetrafluorethylene (ePTFE).

The microporous polytetrafluoroethylene waterproof and water vapour permeable membrane may be a membrane of expanded polytetrafluoroethylene as taught in U.S. Pat. Nos. 3,953,566 and 4,187,390. Such membranes of expanded polytetrafluoroethylene are present in commercially available fabrics from W. L. Gore and Associates, under the tradename GORE-TEX® fabric. The water vapor permeable and waterproof membrane may be composed of a polyurethane coated microporous expanded polytetrafluoroethylene membrane made substantially according to the teachings of U.S. Pat. Nos. 4,194,041 and 4,942,214 assigned to W.L. Gore and Associates, Inc, in Elkton, Md. A further support material such as a knitted textile on one or both sides of the membrane may be present.

In embodiments, the waterproof and water vapour permeable membrane comprises a laminate of a membrane and a support layer or a membrane that is sandwiched between two support layers. The support layers may be textile layers as discussed above. A support layer on the surface of waterproof and water vapour permeable membrane facing the net material may only be an open mesh material or an open textile layer. Open textile layer and open mesh material in this regard means any material that allows for the injected polymeric material of the sole to fully penetrate the textile material or the open mesh material. The textile layer is preferably a knit or a woven.

The waterproof and water vapour permeable membrane may be present in the total length of the upper. Alternatively, the waterproof and water vapour permeable membrane may only be present in the area of the upper that surrounds the foot of the wearer, for example from the bottom of the foot to the area that surrounds the ankle of the wearer but not further.

The insole may be made of any suitable material such as for example bonded leather, synthetic fabrics, thermoplastic polymers, fibreboard or rubber. The insole may be a lasting board, a strobel board or a toe lasting board. A lasting board may have a higher stiffness and hardness than a strobel board. A strobel board is typically a textile material to enable stitching the of the net material and the liner to the strobel board. A toe lasting board is a lasting board with smaller dimensions to allow for sealing of the bootie between the toe lasting board and the seam sewing the strobel board to the bootie.

Typical lasting adhesives such as hotmelt or pressure sensitive adhesives can be used, for example co-polyester or polyamide hotmelt adhesives or polyurethane.

When a protective toe cap is a safety toe cap this safety toe cap extends to the edge of the lasting board and potentially not enough injected sole material would be able to penetrate through the net material onto the waterproof and water vapour permeable membrane of the upper to seal the footwear article. In order to improve the amount of injected sole material to reach the waterproof and water vapour permeable membrane a lasting board comprising a window and a spacer can be used as insole. Around the window a spacer material may be attached on the upper surface of the insole facing the underside of the foot of the wearer. The spacer may have raised edges around the window with channels for the injected sole material to flow through towards the waterproof and water vapour permeable membrane. Alternatively it may be a mesh. The mesh may be glued over the window. The spacer material preferably has a thickness of at least 2 mm.

The sole may be made from a polymeric material such as polyurethane, thermoplastic polyurethane (TPU) or ethylene vinyl acetate (EVA) and injected over the bottom of the footwear construction that is assembled on a last.

At the end of the manufacturing process a footbed may be placed into the footwear article. The footbed may be made from material that cushions the foot of the wearer and provides a better fit and further thermal insulation.

In embodiments, the footbed may comprise two layers of material. The bottom layer facing the sole may be made from for example polyurethane (PU) foam, ethylene-vinyl acetate (EVA), polyethylene (PE) foams. The upper layer facing the foot of the wearer may be made from any of the materials disclosed for the inner layer. In embodiments, the upper layer may be made from the same material as the inner layer of the footwear article. The footbed may be removable and not be attached to the insole and/or inner layer.

FIG. 1 shows a waterproof and water vapour permeable footwear article 10 comprising an upper 40, an insole 60, a sole 90, and a net material 50, wherein the upper 40 comprises a laminate of an outer material 20 and a waterproof and water vapour permeable membrane 30. The top end of the net material 50 is attached to the waterproof and water vapour permeable membrane 30 of the upper 40 at the bottom edge of the upper 40 by a seam 80. In order to seal the waterproof and water vapour permeable footwear article 10 durably the net material 50 and the waterproof and water vapour permeable membrane 30 of the upper 40 overlap in the seam area, preferably for at least 6 mm, to ensure that the injected sole polymer covers a portion of the waterproof and water vapour permeable membrane. The bottom end of the net material 50 is attached to the underside of the insole 60 by lasting adhesive 70. A sole 90 is injected over the last. Preferably the sole material covers partly the bottom end of the outside of the upper 40. As shown in FIG. 1 the polymeric material of the injected sole 90 will penetrate through the net material 50 to provide a waterproof seal between the sole 90 and the waterproof and water vapour permeable membrane 30 of the upper 40. In addition, as shown in FIG. 1 the sole 90 may be raised above the seam 80 to provide a further seal. The upper may further comprise a backing layer laminated to the waterproof and water vapour permeable membrane 30 on the inside facing surface thereof (not shown).

Figure 2:
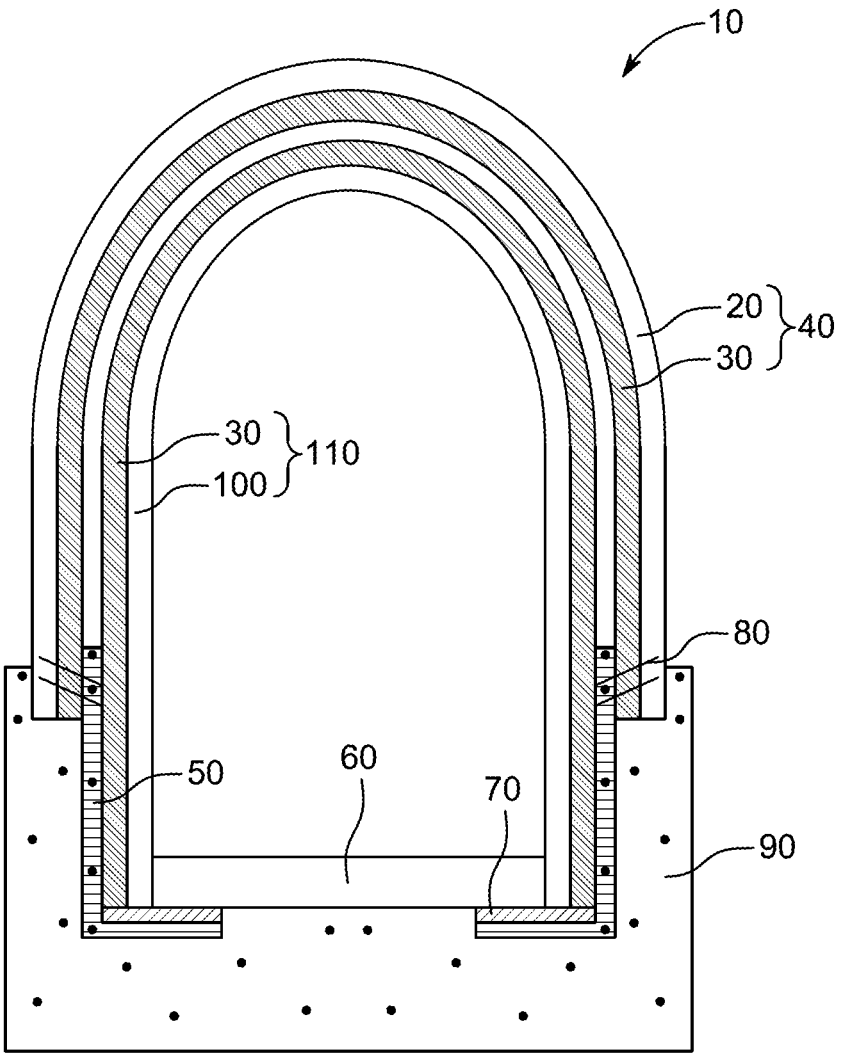
FIG. 2 is a cross-sectional view of a waterproof and water vapour permeable footwear article comprising a net material and a liner.

FIG. 2 shows a waterproof and water vapour permeable footwear article 10 which further comprises a liner 110. The liner 110 includes one layer of a waterproof and water vapour permeable material 30, such as a waterproof and water vapour permeable membrane and a textile layer 100 which have been laminated. In embodiments the liner may comprise three layers with two layers being textile layers and preferably the waterproof and water vapour permeable membrane sandwiched between the two textile layers. Any textile layer laminated to a waterproof and water vapour permeable membrane and facing the net material needs to have an open structure to allow for flow of the injected polymer from the net material to the waterproof and water vapour permeable membrane. In FIG. 2 the liner 110 is open at the bottom and is held in place by the injected sole polymer that has penetrated through the net material 50. The net material is sewn to the waterproof and water vapour permeable membrane 30 of the upper 40 but not to the liner 110. The liner 110 may also be in the form of a bootie. Alternatively the liner 110 may be in the form of a bootie in the toe area and in an open configuration in the rest of the waterproof and water vapour permeable footwear article 10. In this embodiment a toe lasting board is used in the toe area.

Figure 3:
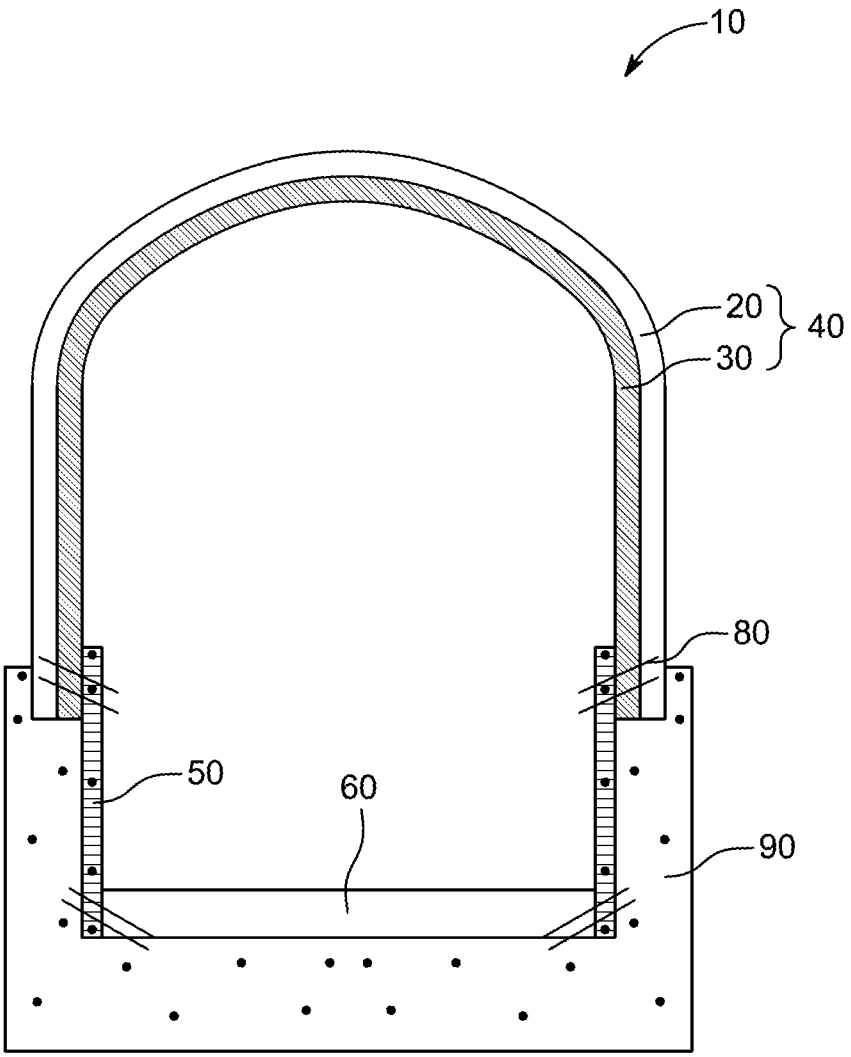
FIG. 3 is a cross-sectional view of a waterproof and water vapour permeable footwear article comprising a net material.
Figure 4:
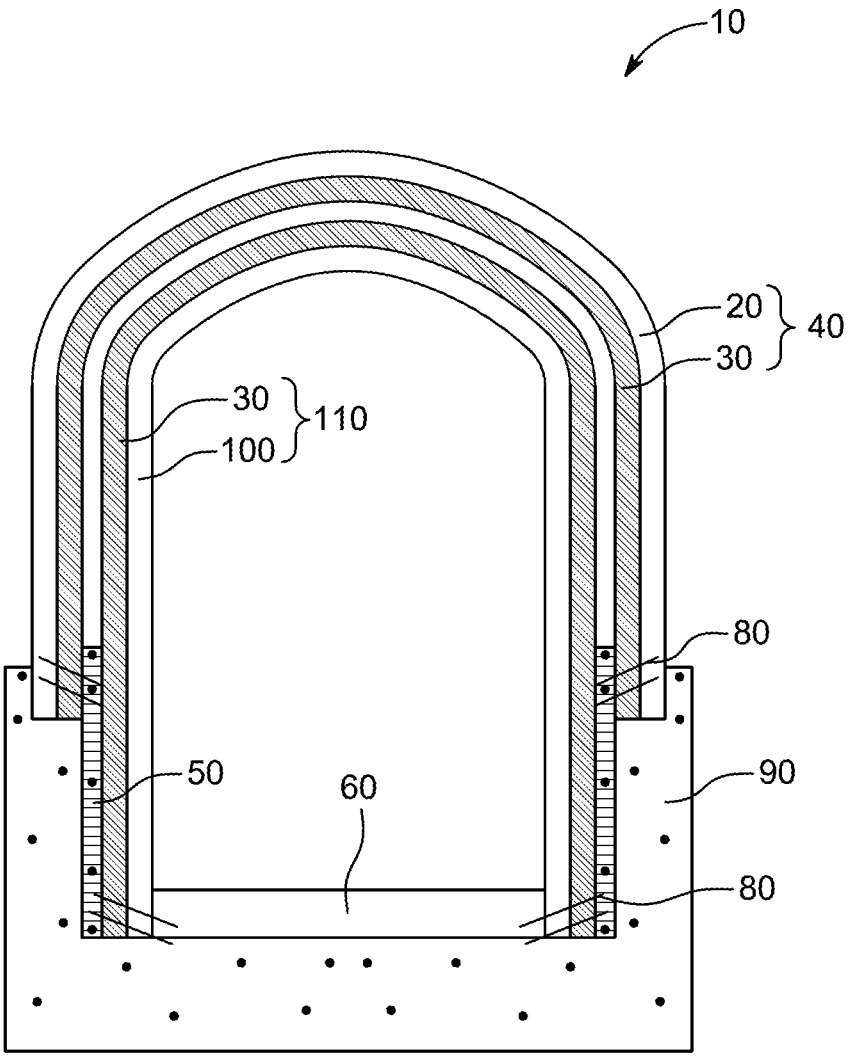
FIG. 4 is a cross-sectional view of a waterproof and water vapour permeable footwear article comprising a net material and a liner.

The embodiments shown in FIGS. 3 and 4 differ from the ones of FIGS. 1 and 2 in that the net material 50 is sewn to the other components of the footwear article at both ends. In FIG. 3 the top end of the net material 50 is sewn to the waterproof and water vapour permeable membrane 30 of the upper 40 while the bottom end is sewn to the insole 60. The insole 60 is a strobel board. The net material 50 will allow injected sole polymer to climb up the net material to waterproof all seams 80 and provide a seal between waterproof and water vapour permeable membrane 30 of the upper 40 and sole 80 rendering the footwear article 10 waterproof.

A liner 110 comprising a waterproof and water vapour permeable membrane 30 is attached in the embodiment of FIG. 4. The liner 110 is attached to the insole with the same seam that attaches the bottom end of the net material to insole 60. When the polymeric sole material is injected to mould the sole 90 the polymeric material will penetrate through the net band 50 and contact both waterproof and water vapour permeable membranes 30 of the upper 40 and the liner 110.

Figure 5:
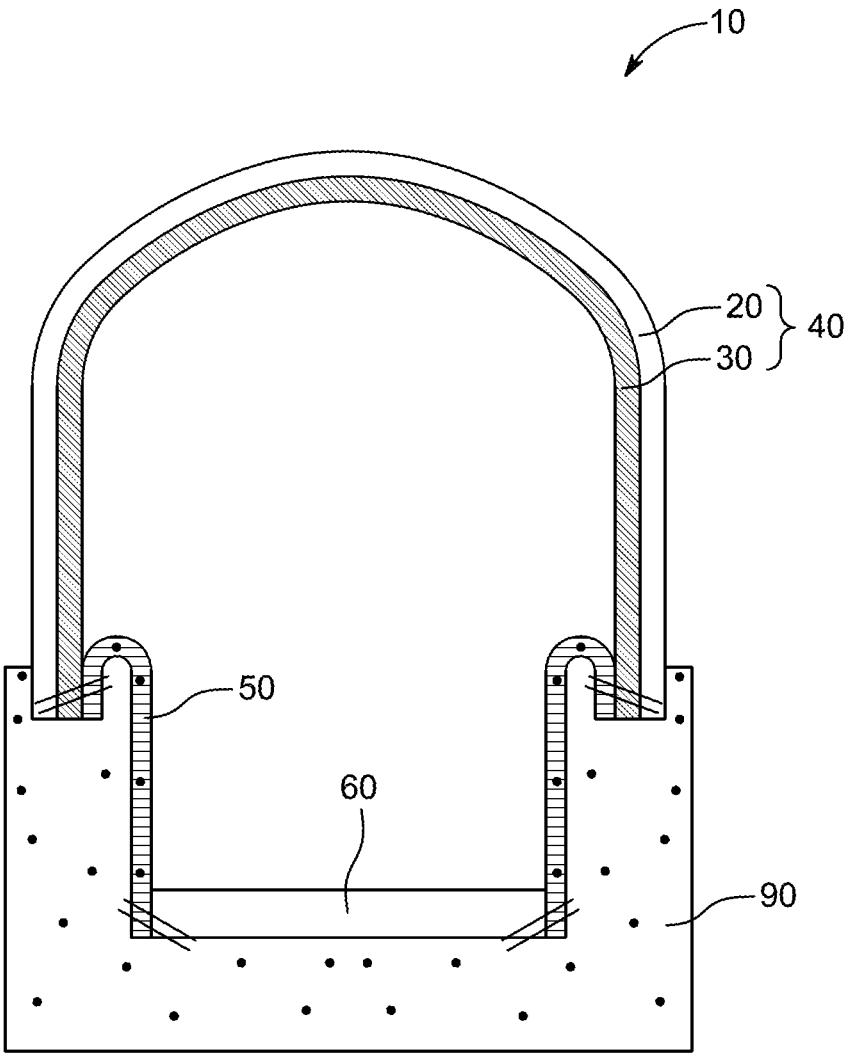
FIG. 5 is a cross-sectional view of a waterproof and water vapour permeable footwear article comprising a net material.

FIG. 5 shows a further embodiment where the net material 50 is attached to the waterproof and water vapour permeable membrane 30 of the upper 40 at the inside facing surface of the net material 50 at a rolled edge. The embodiments of FIGS. 1 to 4 show the attachment of the net material 50 to the waterproof and water vapour permeable membrane with the outside facing surface of the net material 50. In the embodiment of FIG. 5 the top end of the net material 50 has a rolled edge such that the inside facing surface is now facing the waterproof and water vapour permeable membrane 30 of the upper 40. The resulting arc of the net material 50 which will be penetrated by sole polymer during injection of the sole polymer 90 allows for a durable waterproof seal.

The present invention has been described according to preferred embodiments, but equivalents and variants are possible without departing from the scope of the appended claims.

What is claimed is:

1. A waterproof and water vapour permeable footwear article comprising an upper, an insole, a sole, and one net material;

wherein the upper comprises an outer material and a waterproof and water vapour permeable membrane, and wherein the waterproof and water vapour permeable membrane is laminated to the surface of the outer material facing the inside of the footwear article and present in the total length of the upper, wherein at least the top end of the one net material is attached to the waterproof and water vapour permeable membrane of the upper at the bottom perimeter edge of the upper on the surface of the waterproof and water vapour permeable membrane that faces the inside of the footwear article.

2. The waterproof and water vapour permeable footwear article of claim 1, wherein the one net material is attached to the waterproof and water vapour permeable membrane with a seam.

3. The waterproof and water vapour permeable footwear article of claim 1, wherein the one net material and the waterproof and water vapour permeable membrane overlap for at least 6 mm.

4. The waterproof and water vapour permeable footwear article of claim 1, wherein the one net material comprises a rolled edge at the top end such that the inside facing surface of the one net material is attached to the waterproof and water vapour permeable membrane.

5. The waterproof and water vapour permeable footwear article of claim 1, wherein the one net material is attached to the waterproof and water vapour permeable membrane with the outside facing surface of the one net material.

6. The waterproof and water vapour permeable footwear article of claim 1, wherein at least the bottom end of the one net material is attached to the insole.

7. The waterproof and water vapour permeable footwear article of claim 6, wherein the one net material is attached to the insole with a seam.

8. The waterproof and water vapour permeable footwear article of claim 1, wherein the insole is a lasting board, a strobel board or a toe lasting board.

9. The waterproof and water vapour permeable footwear article of claim 1, wherein the upper further comprises a textile or a mesh layer laminated to the inside facing surface of the waterproof and water vapour permeable membrane.

10. The waterproof and water vapour permeable footwear article of claim 1, wherein the footwear article further comprises a liner and optionally wherein the liner comprises a waterproof and water vapour permeable membrane.

11. The waterproof and water vapour permeable footwear article of claim 10, wherein the liner forms a bootie.

* * * * *